US010035572B1

(12) United States Patent
Armendariz

(10) Patent No.: US 10,035,572 B1
(45) Date of Patent: Jul. 31, 2018

(54) SURVIVIAL DRESS UNIT

(71) Applicant: Victor Armendariz, Cutler Bay, FL (US)

(72) Inventor: Victor Armendariz, Cutler Bay, FL (US)

( * ) Notice: Subject to any disclaimer, the term of this patent is extended or adjusted under 35 U.S.C. 154(b) by 0 days.

(21) Appl. No.: 15/619,829

(22) Filed: Jun. 12, 2017

(51) Int. Cl.

| | |
|---|---|
| ***B63C 9/15*** | (2006.01) |
| ***A41D 1/08*** | (2018.01) |
| ***A41D 13/012*** | (2006.01) |
| ***A41D 27/20*** | (2006.01) |

(52) U.S. Cl.
CPC ..... *B63C 9/155* (2013.01); *A41D 1/08* (2013.01); *A41D 13/0125* (2013.01); *A41D 27/205* (2013.01); *A41D 27/208* (2013.01)

(58) Field of Classification Search
CPC ..... B63C 9/155; A41D 1/08
USPC ..... 441/88, 102, 103
See application file for complete search history.

(56) References Cited

U.S. PATENT DOCUMENTS

| | | | | |
|---|---|---|---|---|
| 262,703 A | | 8/1882 | Sibley | |
| 2,490,556 A | | 12/1949 | Spack | |
| 2,607,934 A | | 8/1952 | Bailhe | |
| 3,266,069 A | | 8/1966 | O'Link | |
| 4,734,072 A | * | 3/1988 | Lastnik | B64D 10/00 441/105 |
| 5,079,778 A | | 1/1992 | Sloot | |
| 5,297,576 A | | 3/1994 | Weinheimer | |
| 6,106,348 A | | 8/2000 | Loisel | |
| 6,231,411 B1 | | 5/2001 | Vinay | |
| 6,551,160 B1 | * | 4/2003 | Toth | B63C 9/1055 441/104 |
| 6,681,399 B1 | * | 1/2004 | Kerr | A41D 13/0125 2/2.5 |
| 7,004,808 B1 | * | 2/2006 | Nelson | B63C 9/1255 441/106 |
| 7,013,489 B1 | * | 3/2006 | McGrath | B63C 9/105 2/69 |
| 7,059,924 B2 | * | 6/2006 | Farmer | A41D 13/0125 441/106 |

(Continued)

FOREIGN PATENT DOCUMENTS

| | | |
|---|---|---|
| WO | WO 00/15492 | 3/2000 |

*Primary Examiner* — S. Joseph Morano
*Assistant Examiner* — Jovon E Hayes
(74) *Attorney, Agent, or Firm* — MALLOY & MALLOY, PL

(57) ABSTRACT

A wearable dress unit comprising a garment assembly, an inflatable bladder connected to the garment assembly, a plurality of connection structures disposed on an exterior of the garment assembly, an inflation assembly disposed in fluid communication with an inside of the inflatable bladder, and a pocket structure. The garment assembly is wearable at all times when worn in a conventional position, and provides flotation when removed and disposed in a flotation position. The plurality of connection structure forms a retaining engagement that at least partially secures the garment assembly to the individual. The inflation assembly may dispose the inflatable bladder into an expanded and a collapsed orientation. When respectively disposed in the flotation position and in the expanded orientation, the garment assembly and the inflatable bladder are cooperatively configured to provide flotation to the individual. The pocket structure may retain and permit operation of a communication device.

15 Claims, 17 Drawing Sheets

(56) References Cited

U.S. PATENT DOCUMENTS

| | | | | |
|---|---|---|---|---|
| 7,150,668 | B2 * | 12/2006 | Kemp | A41D 13/0125 441/106 |
| 7,288,011 | B2 * | 10/2007 | Ganley | B63C 9/1255 441/106 |
| 7,305,715 | B2 * | 12/2007 | Orsos | A41D 7/003 2/67 |
| 7,824,239 | B2 * | 11/2010 | Weinel | A62B 33/00 441/114 |
| 7,937,770 | B1 * | 5/2011 | Hernandez | A41D 7/003 2/67 |
| 8,011,019 | B1 | 9/2011 | Hamid et al. | |
| 8,104,096 | B1 | 1/2012 | Jenney | |
| 9,067,658 | B2 * | 6/2015 | Hughes | B63C 9/1255 |
| 9,161,577 | B1 | 10/2015 | Harper | |
| 2004/0033739 | A1 * | 2/2004 | Courtney | B63C 9/065 441/88 |
| 2006/0026734 | A1 | 2/2006 | Fitzgerald | |
| 2006/0117464 | A1 | 6/2006 | Capstran | |
| 2009/0124147 | A1 | 5/2009 | Pertez | |
| 2010/0015867 | A1 | 1/2010 | Betz et al. | |
| 2013/0014310 | A1 | 1/2013 | Tang | |
| 2013/0019959 | A1 | 1/2013 | Chen | |
| 2016/0150836 | A1 | 6/2016 | Gomes De Paiva et al. | |

* cited by examiner

SURVIVIAL DRESS UNIT

BACKGROUND OF THE INVENTION

Field of the Invention

The present invention relates to a dress unit configured to be worn in a conventional position on a wearer, but which may also be used to provide flotation to an individual, when removed from the conventional position on the wearer and disposed in a floatation position.

Description of the Related Art

Certain activities, such as boating, jet skiing, and other related activities, will often require the availability of life vests or similar devices in case of an emergency. An individual's enjoyment of the activity may be compromised by the perceived risk of falling into the water. Thus, for some activities it becomes essential to wear at all times a protective device such as a life vest. The lack of comfort involved with having to wear a life vest at all times is a significant drawback as some life vests can be bulky.

There is a need in the industry to provide a dress unit that may be worn at all times as a conventional pair of pants or shorts, but that may also be effortlessly disposed and used as a flotation device in case of an emergency. A benefit would be realized by providing a dress unit that may be worn at all times without having to sacrifice comfort. A further benefit would also be realized if such a dress unit would be reusable, would be light but sturdy, and would comprise a built in bladder that can provide flotation to an individual. An even further benefit would also be realized by providing a dress unit that may be manually inflated or deflated in a relative small period of time and with relative ease.

SUMMARY OF THE INVENTION

The present invention is directed towards a dress unit that may be worn by an individual as a conventional pair of pants or shorts, but which may be also used to provide flotation to the individual when desired. The present invention is also directed towards a method of using the inventive dress unit as a flotation device. The wearable dress unit of the present invention comprises a garment assembly, a connection assembly disposed on the garment assembly, an inflatable bladder connected to the garment assembly, an inflation assembly disposed in fluid communication with an inside of the inflatable bladder, and a pocket structure configured to retain and at least partially operate a communication device.

The garment assembly generally comprises a first and a second extended segment connected to a core segment. The first and second extended segments of the garment assembly are each structured and dimensioned to receive a corresponding leg of the individual. The inflatable bladder is generally connected to an inside of the garment assembly, and more specifically to an inside of a front portion of the garment assembly. The inflation assembly generally comprises an inflation device that may be used to inflate the inflatable bladder. The inflation device may function manually, so that the individual may blow air through the inflation device to inflate the inflatable bladder and to dispose it into an expanded orientation. Alternatively, the inflation device may be an automatic inflation device that may inflate the inflatable bladder without the individual having to blow air. The inflation assembly may also comprise a release valve which may be used to dispose the inflatable bladder into a collapsed orientation. In the collapsed orientation virtually all of the air inside of the bladder has exited the inflatable bladder leaving it substantially deflated.

When the inflatable bladder is disposed in the collapsed orientation, the individual may wear the inventive dress unit in a conventional position. That is, the individual may wear the inventive dress unit as a pair of pants or shorts. In an alternative embodiment of the dress unit according to the present invention, the individual may also wear the inventive dress unit either as a shirt or as a jacket. A feature of the present invention is that the individual may not only wear the dress unit in the conventional position, but may do so with relative comfort. The inflatable bladder comprises a predetermined thickness, when it is disposed in the collapsed orientation, which enables a comfort factor. More specifically, the predetermined thickness of the inflatable bladder is such that the inflatable bladder is substantially coincident with the thickness of the garment assembly.

The garment assembly may also be disposed into a flotation position if so desired. The flotation position comprises the garment assembly being removed, from the conventional position on the wearer, and secured to the individual, in the flotation position. In the flotation position, the garment assembly is preferably secured to an upper portion of the individual so that the inflatable bladder may provide flotation to the individual while maintaining the head of the individual above water.

The connection assembly comprises a plurality of connection structures each of which is disposed on the garment assembly. The plurality of connection structures may comprise at least a first and a second connection structure each respectively disposed on the first and on the second extended segments of the garment assembly. The first and the second connection structures may form this retaining engagement substantially along the chest area of the individual. The connection assembly may also comprise a third and a fourth connection structure each of which is also respectively disposed on the first and the second extended segments of the garment assembly. Furthermore, a strap may be connected to the garment assembly. When the garment assembly is worn in the conventional position, the strap essentially functions as a belt that can maintain the garment assembly in a fixed position relative to the individual. When the garment assembly is disposed into the flotation position, the strap may be connected both to the third and fourth connection structures substantially around the back of the individual. The length of the strap may be adjusted to the size of the individual. As such, the strap may provide a further mechanism to secure the individual to the connection structure.

Yet additional features of the present invention include providing a pocket structure that is waterproof and that may retain a communication device. The pocket structure may be disposed on either of the first or second extended segments and comprises a waterproof material. Thus, the waterproof material of the pocket structure prevents passage of water from an outside to an inside of the pocket structure. Even when submerged in the water, the individual may be able to operate the communication device, from an exterior of the pocket structure, to send a distress or emergency signal or to make an emergency call.

The dress unit may comprise a charging assembly disposed within the pocket structure to replenish the charge of the communication device. The charging assembly may comprise a solar powered charging device. The pocket structure may also comprise a clear, or transparent material so that the inside of the pocket structure is observable from the outside of the pocket structure, and as such is exposed to solar radiation. This feature permits the individual to observe the communication device when attempting to operate it. The clear or transparent material also works to enable operation of the solar powered device. Additionally, pocket structure may comprise a cover attached to at least a portion of the garment assembly. The cover may be structured to correspond to an intended visual appearance of the garment assembly. Thus, the cover may comprise a material or fabric that visibly matches that of the garment assembly. Furthermore, the color of the cover may also match the color of the garment assembly.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 14:
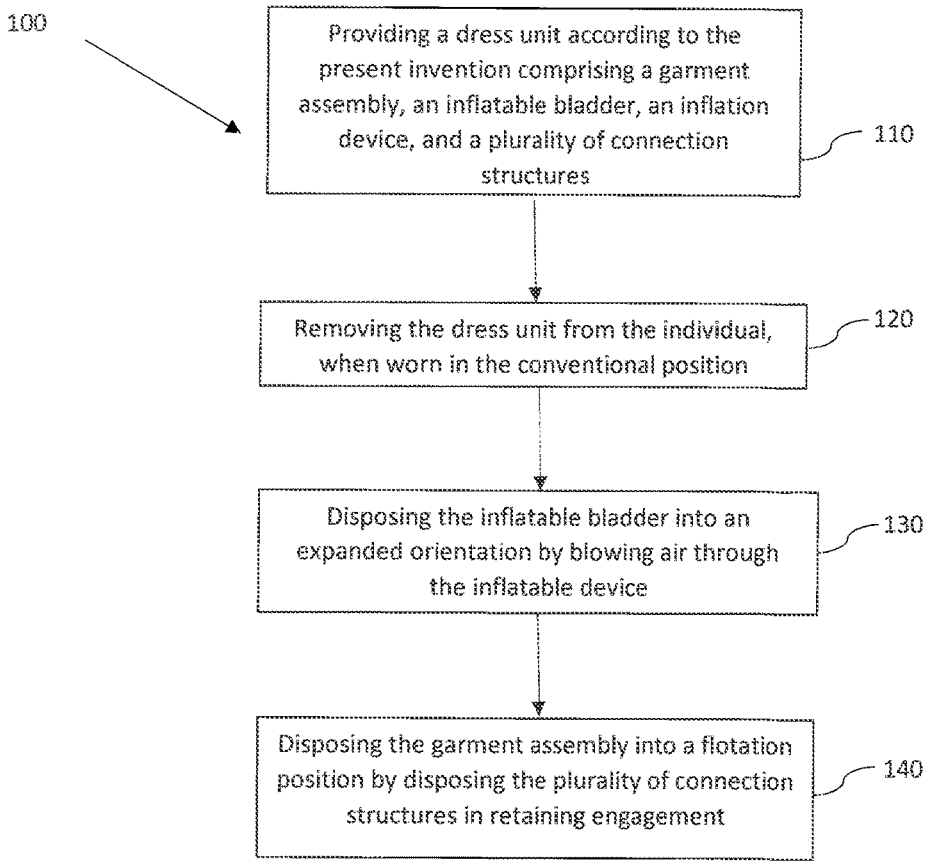
FIG. 14 is a block diagram illustrative of one embodiment of a method of using the dress unit according to the present invention.
Figure 15:
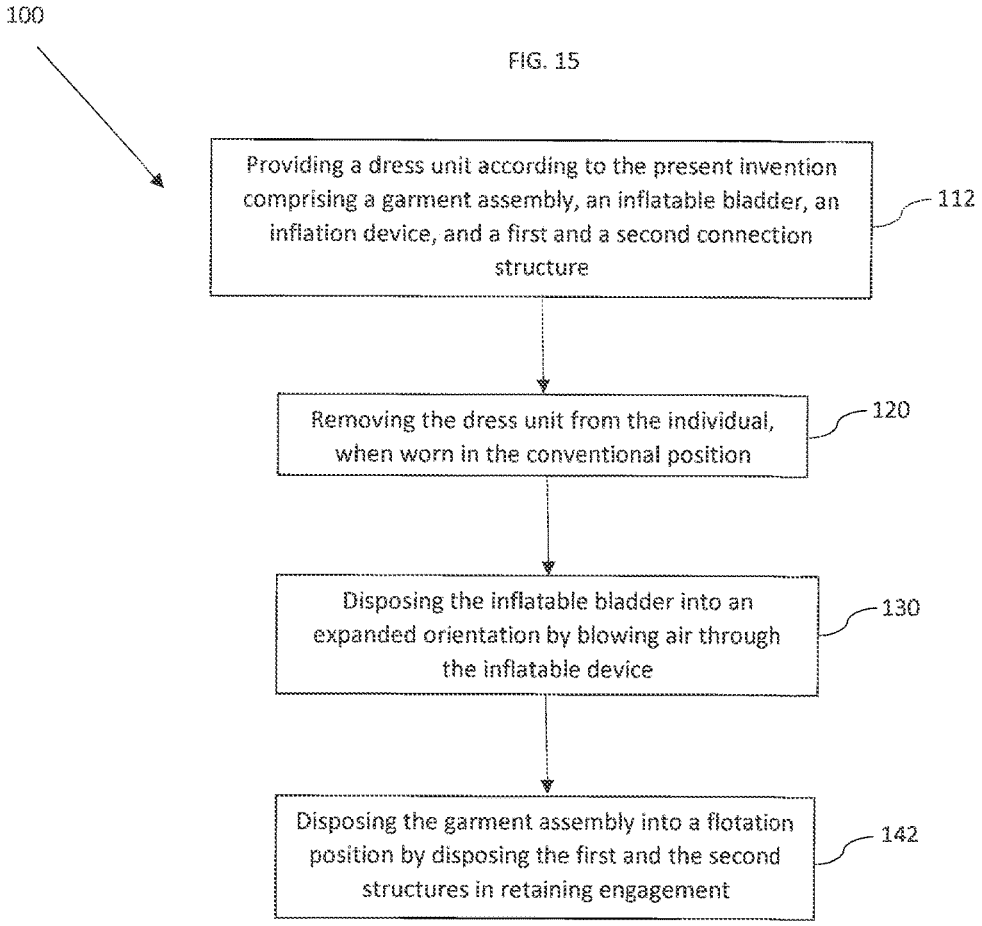
FIG. 15 is a block diagram illustrative of one alternative embodiment of a method of using the dress unit according to the present invention.
Figure 16:
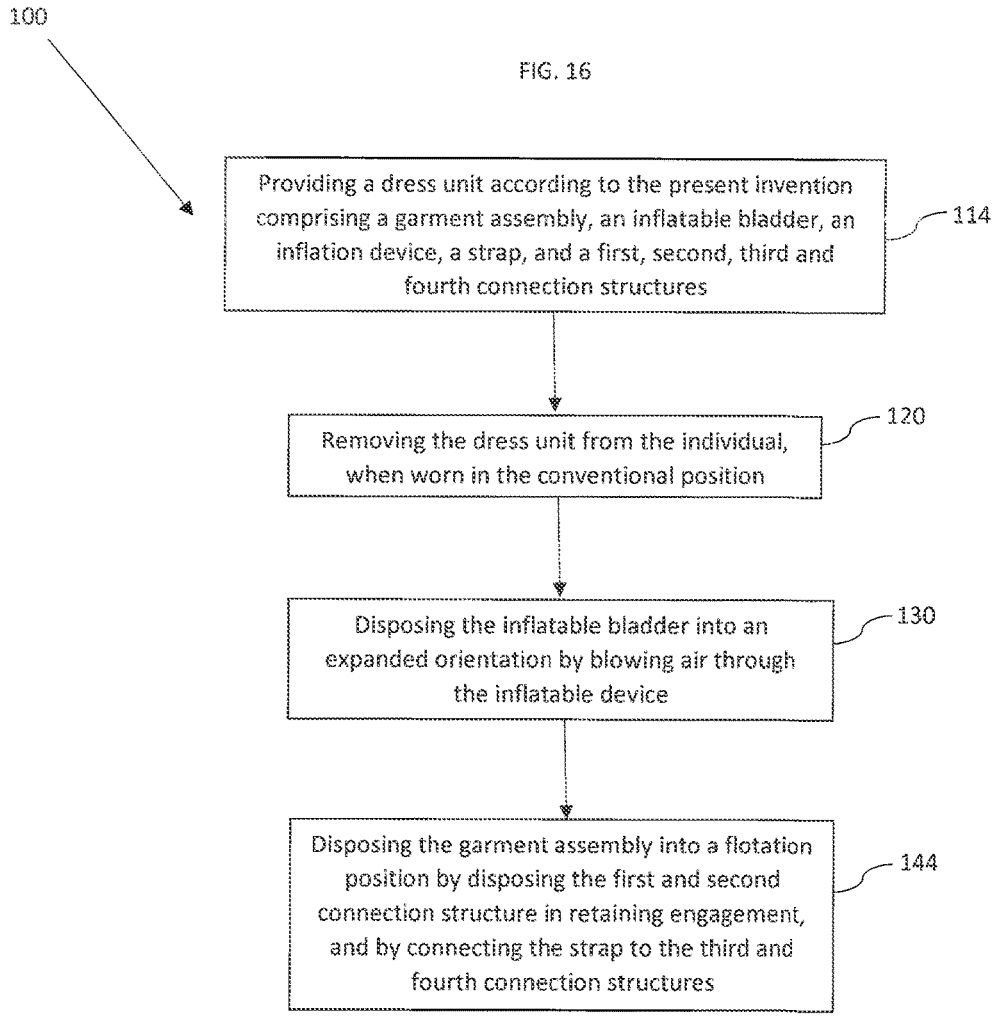
FIG. 16 is a block diagram illustrative of a different alternative embodiment of a method of using the dress unit according to the present invention.

The present invention is directed towards a dress unit 1 which may be worn by an individual as a conventional pair of pants, but which may also be used to provide flotation to the individual in case of an emergency. As represented in FIGS. 14-16, the present invention is also directed towards an associated method 100 of using the dress unit 1 to provide flotation to an individual in case of an emergency. The inventive dress unit 1 may be used in a variety of recreational situations such as when riding on a boat, ski jet, or other activity in which the body of the individual may be accidentally submerged under water. Primarily, the dress unit 1 of the present invention comprises a garment assembly 10, a connection assembly 60 disposed on the garment assembly 10, an inflatable bladder 20 connected to the garment assembly 10, an inflation assembly 40 disposed in fluid communication with an inside of the inflatable bladder 20, and a pocket structure 30 configured to retain and at least partially operate a communication device 80.

Figure 1A:
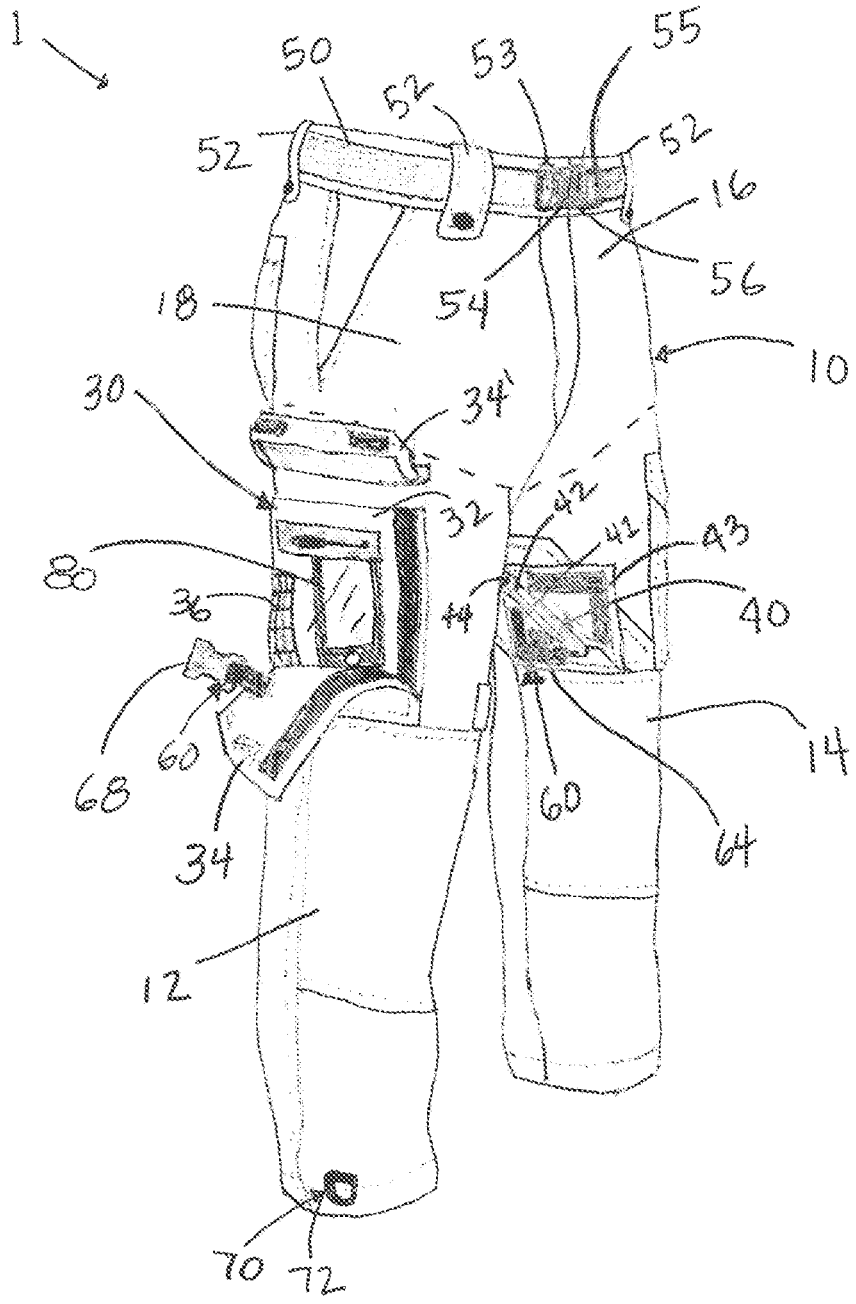
FIG. 1A is a perspective view of one embodiment of the garment assembly of the dress unit according to the present invention.
Figure 1B:
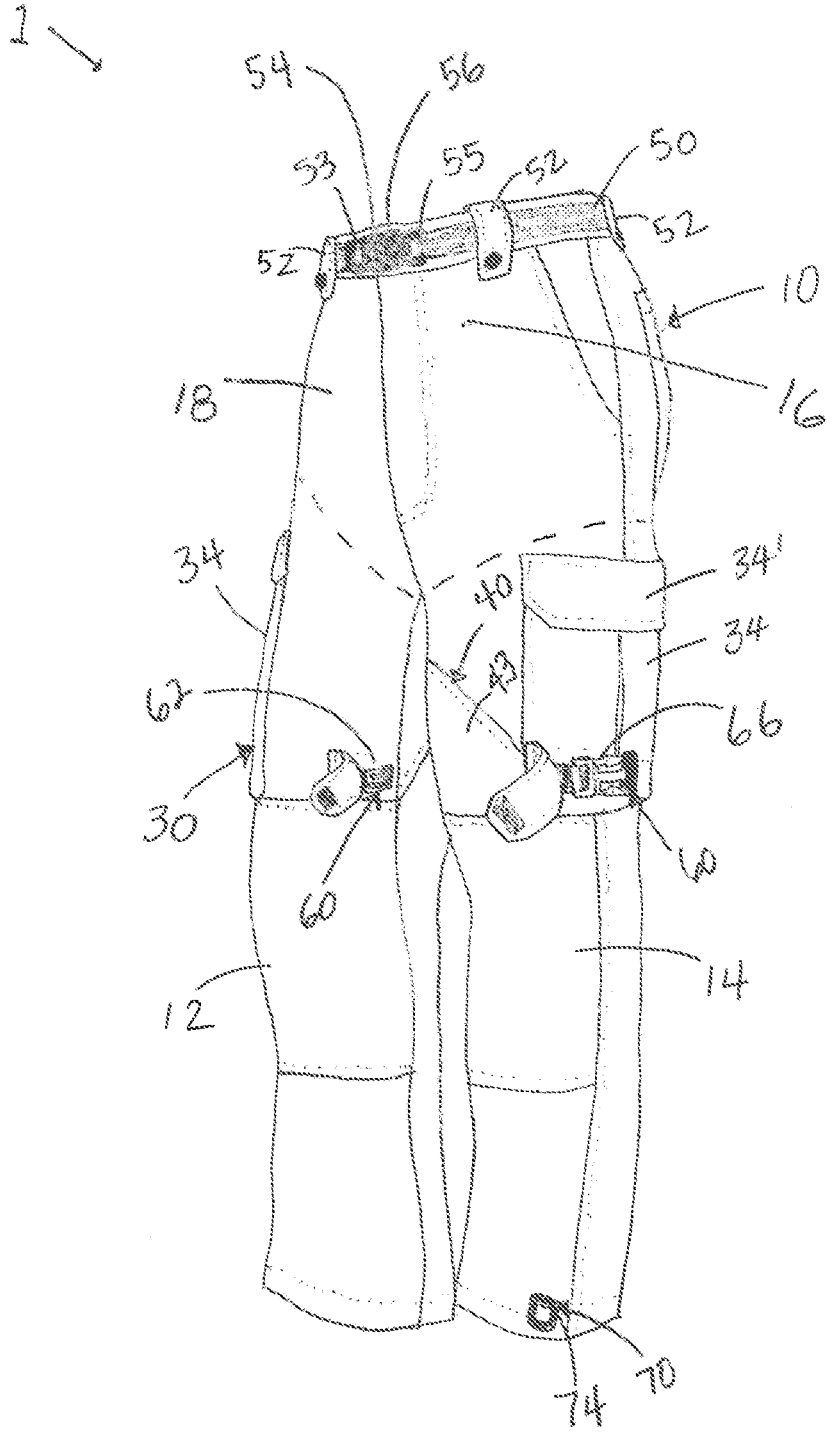
FIG. 1B is a different perspective view of the embodiment as represented in FIG. 1A.
Figure 2:
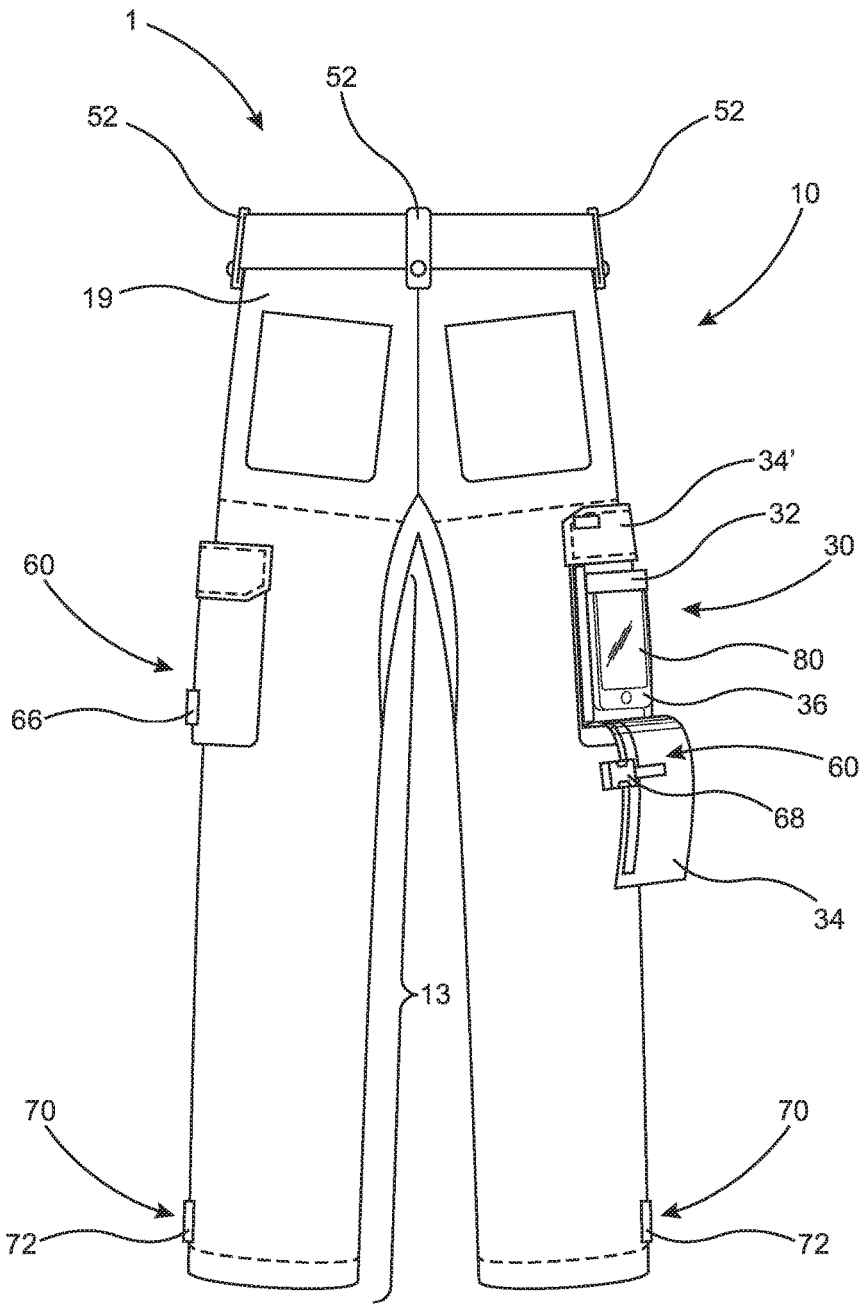
FIG. 2 is a rear view the embodiment as represented in FIGS. 1A and 1B.
Figure 7:
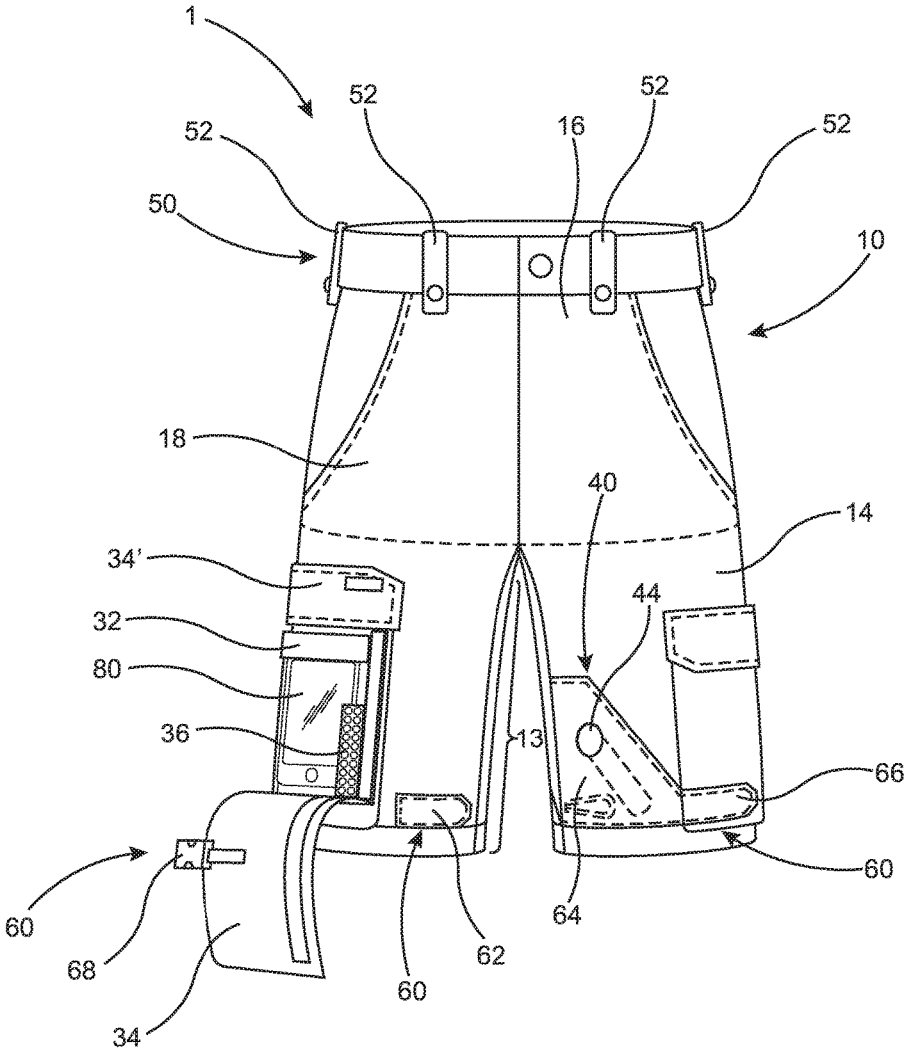
FIG. 7 is a front view of a different embodiment of the garment assembly of the dress unit according to the present invention.
Figure 8:
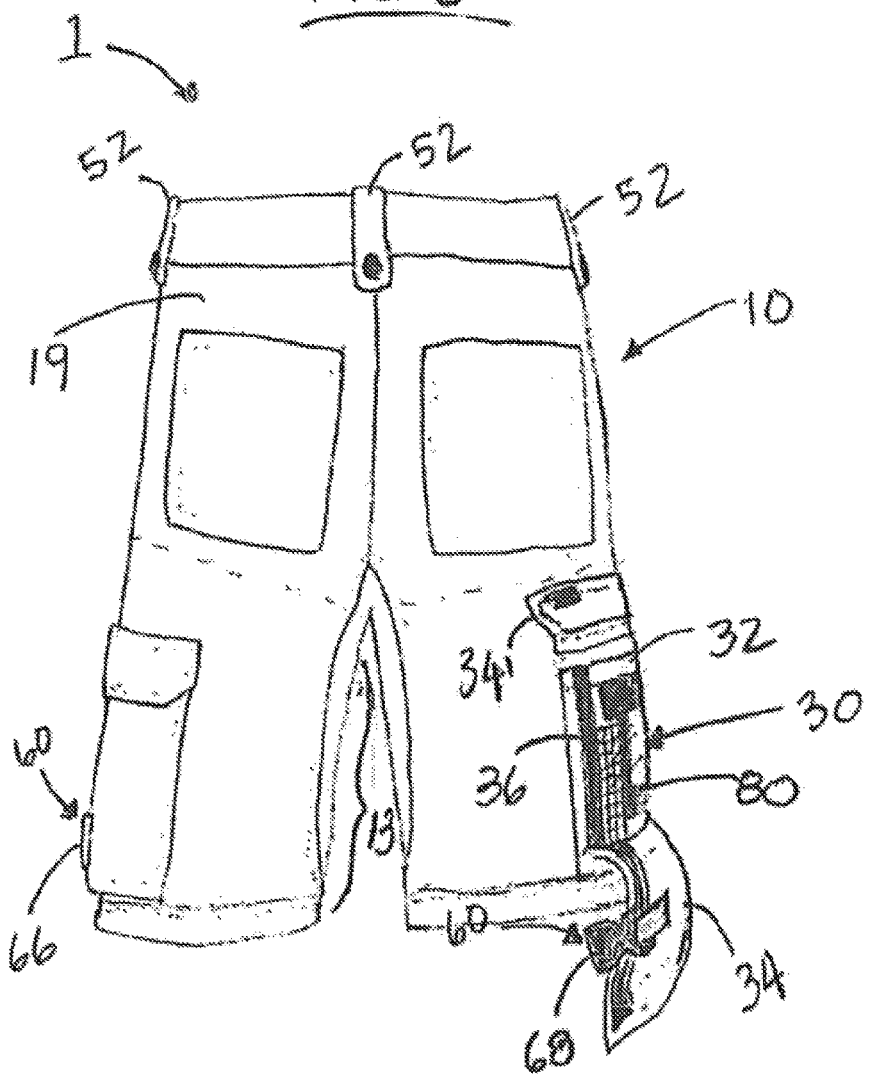
FIG. 8 is a rear view of the embodiment as represented in FIG. 7.

With reference to FIGS. 1A-2 and 7-8, the garment assembly 10 comprises a first and a second extended segment, respectively indicated as 12 and 14, each of which is connected to a core segment 16. The material of the garment assembly 10, including the extended segments 12 and 14, and including the core segment 16, may comprise a variety of fabrics such as, but not limited to, Ripstop fabric. The color of the garment assembly 10 may include, but is not limited to, olive, tan, black, and khaki. It is within the scope of the present invention to provide a garment assembly 10 that may be manufactured in different sizes according to the height and/or size of the individual. Each of the first and the second extended segments 12 and 14 corresponds to a different leg of the individual. As such, each extended segment 12 and 14 should be of a sufficient dimension to receive therein a different leg of the individual. As represented at least in FIGS. 1A-2, the extended segments 12 and 14 may comprise a "full length", indicated as 13 in FIG. 2, such as would normally be associated with a conventional pair pants. As shown at least in FIGS. 7-8, an alternative embodiment of the present invention comprises providing a garment assembly 10 that may be worn as a conventional pair of shorts. Accordingly, in the embodiment as represented in FIGS. 7-8, the extended segments 12 and 14 comprise a "modified length", indicated as 13 which is substantially shorter than the "full length" 13, represented in FIGS. 1A-2. As is perhaps best shown in FIGS. 1A, 1B, and 7, the garment assembly 10 comprises a front section 18. As shown in FIGS. 2 and 8, the garment assembly 10 also comprises a rear section 19. As is shown at least in FIG. 10, the inflatable bladder 20 is connected to the garment assembly 10, and more specifically on an inside 10' of the front section 18 of the garment assembly 10.

Figure 4:
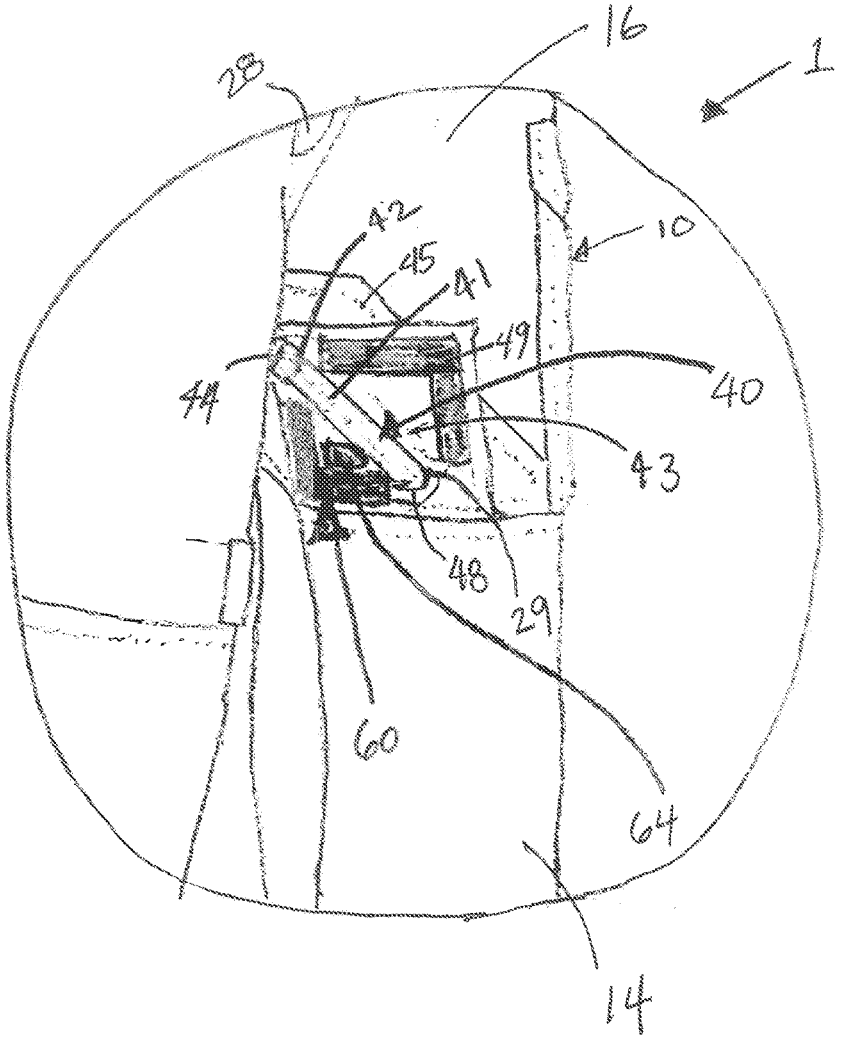
FIG. 4 is a front view of one embodiment of the inflation assembly of the dress unit according to the present invention.
Figure 5:
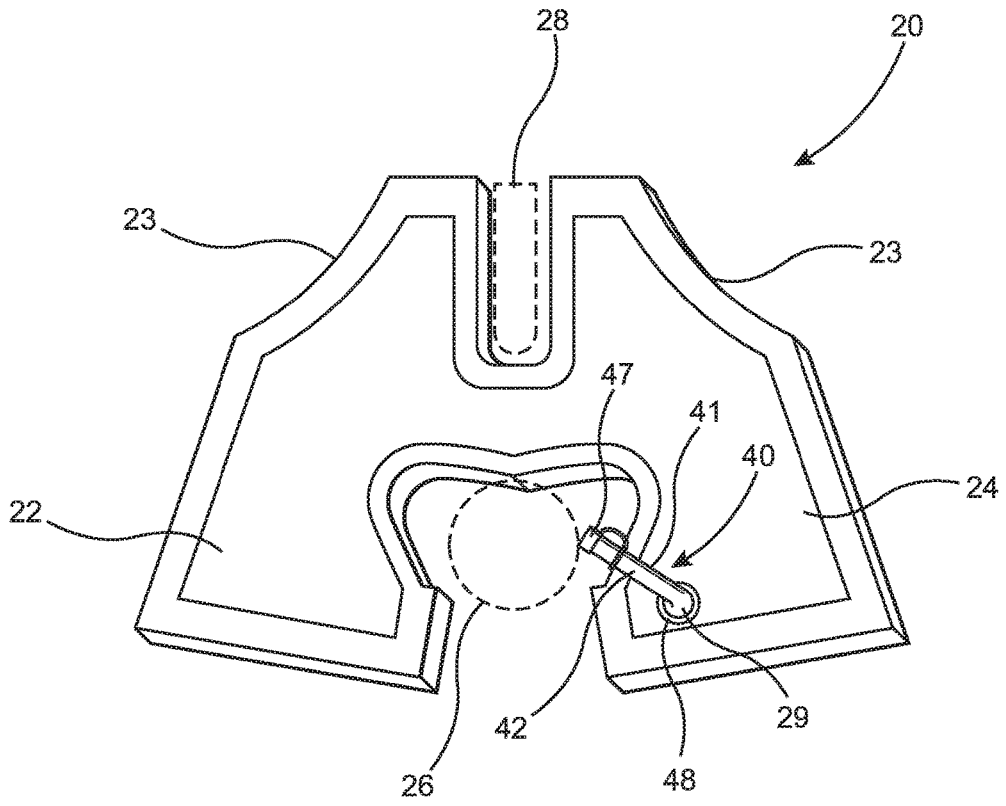
FIG. 5 is a front perspective view of one embodiment of the inflatable bladder of the dress unit according to the present invention.

With primary reference now to FIGS. 4-5, the inventive dress unit 1 comprises an inflation assembly 40 disposed in fluid communication with the inflatable bladder 20. The inflation assembly 40 generally comprises an inflation device 41, which is disposed in fluid communication with an inside of the inflatable bladder 20. The shape of the inflation device 41 may be substantially cylindrical, or another similar shape. Additionally, the inflation device 41 may be manufactured in a variety of different sizes. The inflation device 41 comprises an opening 44 and a hollow structure or tube 42, the inside of which is connected in fluid communication to the inside of the inflatable bladder 20 around an opening 29 of the inflatable bladder 20. As is best shown in FIG. 4, the inflation assembly may also comprise a lid 43 attached to the garment assembly 10 around an upper segment 45 of the lid 43. The inflation device 41 may be secured to the garment assembly by a reinforcement portion 48 which is connected to the garment assembly 10. Both the lid 43 and the reinforcement portion 48 may comprise one or more fasteners, indicated as 49. The fasteners 49 may be in the form of a hook and loop mechanical fastener, or a similar fastener, such as those manufactured under the mark Velcro®. Thus, the material of the fasteners 49 should permit the individual to open the lid 43 with relative ease to expose the inflation device 41 and blow air into the tube 42 to inflate the inflatable bladder 20. Alternatively, the inflation device 41 may be an automatic inflation device. As such, the inflation device 41 may automatically inflate the inflatable bladder 20 without having to blow air through the inflation device 41.

Figure 12:
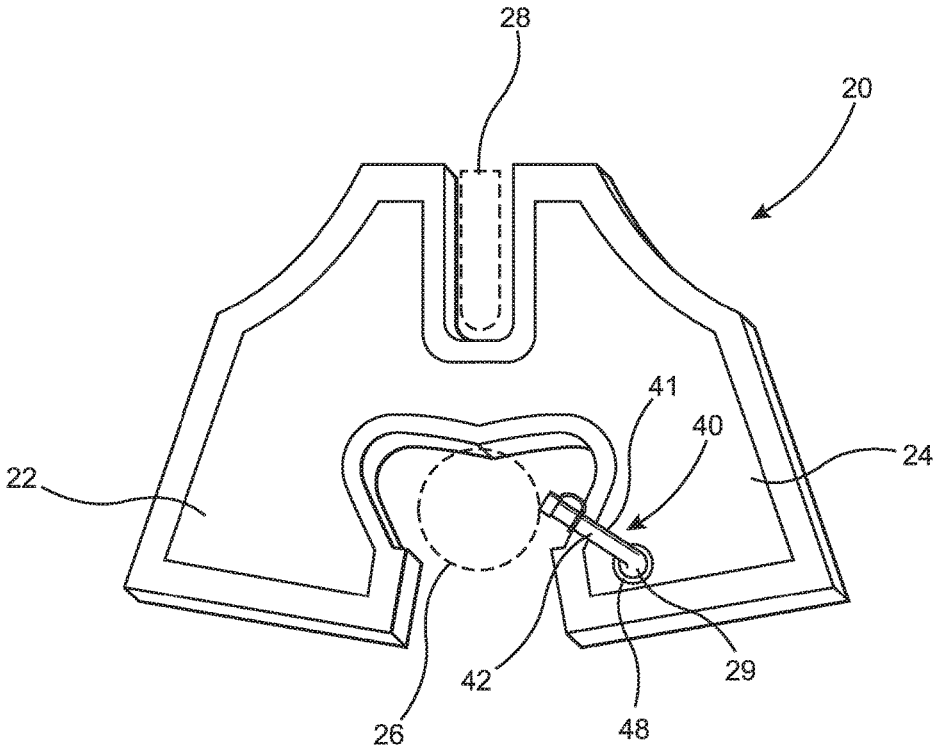
FIG. 12 is a perspective view of one embodiment of the inflatable bladder of the dress unit according to the present invention disposed in the collapsed orientation.
Figure 13:
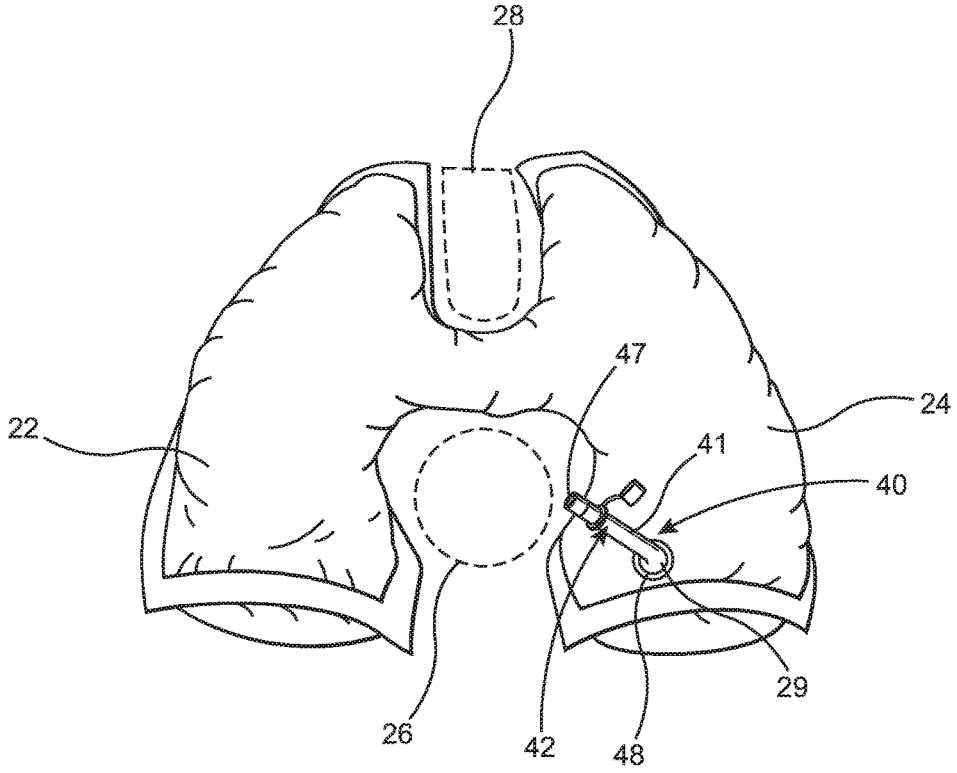
FIG. 13 is a perspective view of one embodiment of the inflatable bladder of the dress unit according to the present invention disposed in the expanded orientation.

The inflatable bladder 20 may be disposed into either a collapsed orientation, as shown in FIG. 12 or into an expanded orientation, as shown in FIG. 13. In the collapsed orientation, virtually all of the air has exited the inflatable bladder 20 such that it is substantially deflated. The inflation assembly 40 may comprise a release valve, generally indicated as 47. As shown in FIG. 5, the release valve 47 may be disposed on the inflation device 41. Alternatively, the release valve 47 may also be disposed directly on the exterior of the inflatable bladder 20. The release valve 47 may be used to substantially deflate the inflatable bladder 20 and to dispose it into the collapsed orientation. When the inflatable bladder 20 is disposed in the collapsed orientation, the individual may wear the inventive dress unit 1, and more specifically the garment assembly 10, in a conventional position. As used herein the conventional position comprises the individual wearing the garment assembly 10 as a conventional pair of pants or as a conventional pair of shorts. In alternative embodiments, the garment assembly 10 may also be configured so that the individual may wear the garment assembly 10 either as an upper body item of clothing such as a shirt, a jacket, or other similar item of clothing.

Figure 10:
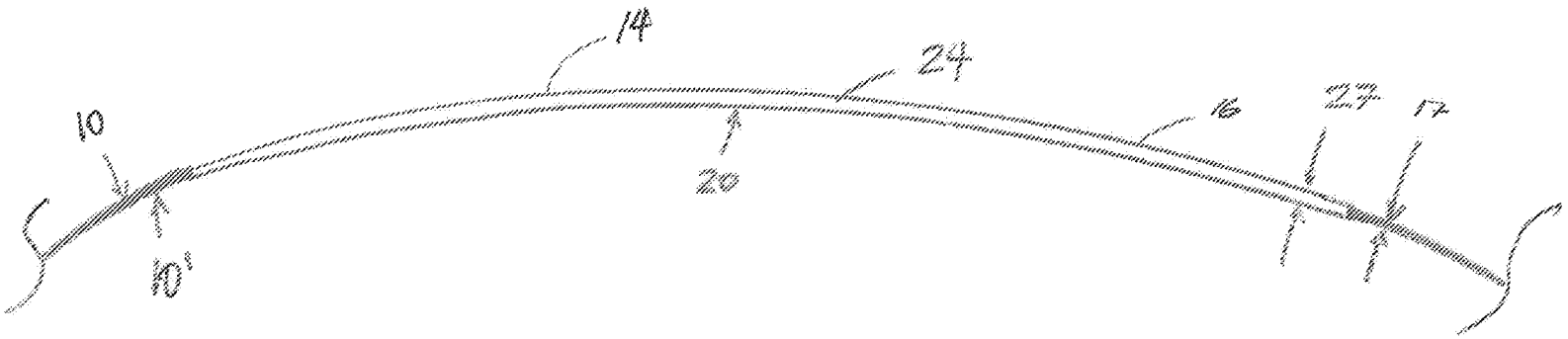
FIG. 10 is a section view of a portion of an extended segment of the garment assembly of the dress unit according to the present invention comprising an inflatable bladder disposed in the collapsed orientation.

With reference now to FIG. 10, a feature of the present invention comprises the individual wearing the dress unit 1 in a conventional position in a manner that provides relative comfort. In order to achieve this relative comfort, the inflatable bladder 20, when disposed in the collapsed orientation, comprises a predetermined thickness 27 that enables a comfort factor when the individual wears the garment assembly 10 in the conventional position. As shown in FIG. 10, this predetermined thickness 27 is substantially coincident with a thickness 17 of the garment assembly 10. Furthermore, the material of the inflatable bladder 20 should be sufficiently flexible so that when disposed in the collapsed orientation, the inflatable bladder 20 can freely conform to the movement of the individual when the dress unit is worn in the conventional position. Conversely, the material of the garment assembly 10 should be sufficiently rigid so that the inflatable bladder 20 can withstand a significant internal pressure of the air when the inflatable bladder 20 is disposed into the expanded orientation. Furthermore, the material of the inflatable bladder 20 should also be such that the garment assembly 10 may be washed without compromising the structural integrity of the inflatable bladder 20.

In case of an emergency, the individual may dispose the garment assembly 10 into a flotation position. The flotation position comprises removing the garment assembly from the individual, when it is worn in the conventional position, and securing it to the individual around the upper portion of the body, as represented in at least FIG. 11. Alternatively, a spare dress unit 1 that is not being worn by anyone may be used to provide flotation. In order to dispose the garment assembly into the flotation position, the inflatable bladder 20 must be disposed into the expanded orientation. Thus, after removing the garment assembly 10 from the conventional position, the user may use the inflation device 41 to inflate the inflatable bladder 20. Once the inflatable bladder 20 is inflated and disposed in the expanded orientation, the individual may use the connection assembly 60 to secure the garment assembly 10 to the upper body portion.

With reference now to FIGS. 1A-2, and 7-8, the connection assembly 60 comprises a plurality of connection structures, including at least a first connection structure 62, a second connection structure 64, a third connection structure 66, and a fourth connection structure 68. As is represented at least in the illustrative embodiment of FIG. 1A, the first connection structure 62 and the second connection structure 64 are respectively disposed on the first extended segment 12 and on the second extended segment 64. In embodiments of the dress unit comprising extended segments 12 and 14 having a "modified length", such as is represented at least in FIG. 7, the first and the second connection structures 62 and 64 should be respectively disposed on the first and second extended segments 12 and 14 along an end portion thereof. As shown in FIGS. 1A and 1B, the garment assembly 10 may comprise a shoe connector assembly 70, disposed on an end of the extended segments 12 and 14. The shoe connector assembly 70 may include a first shoe connector 72 and a second shoe connector 74 respectively disposed on the first extended segment 12 and on the second extended segment 14. The shoe connectors 72 and 74 may further comprise a "hook" configuration structured to attach to a corresponding connector member disposed on each shoe that the individual may wear. As an example, the first and/or the second shoe connectors 72 and 74 may be in the form of a ring produced under the generic term "D-Ring."

Figure 11:
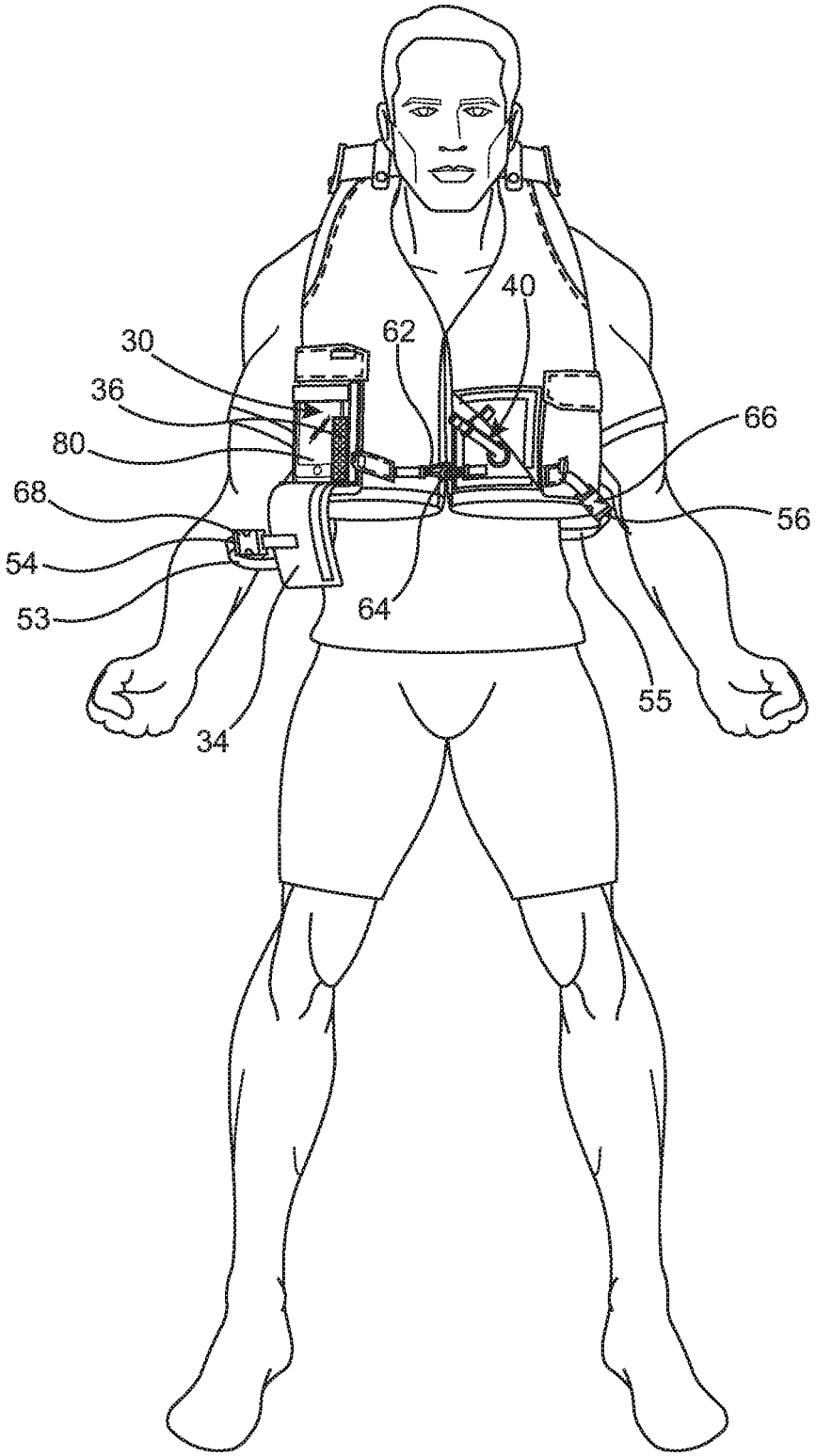
FIG. 11 is a perspective view of one embodiment of the garment assembly of the dress unit according to the present invention disposed in the flotation position wherein a strap is connected to a garment assembly securing the dress unit to the wearer.

As shown at least in FIG. 11, the first and the second connection structures 62 and 66 may form a retaining engagement with one another. The connection structures 62, 64, 66 and 68 may comprise a variety of connection mechanisms such as, but not limited to plastic buckles. Furthermore, the connection structures 62, 64, 66, and 68 may be manufactured in a variety of sizes according to the overall intended size of the garment assembly 10. The mating engagement between the first and the second connection structures 62 and 64 should be formed around the chest area of the individual so that the first and the second extended segments 12 and 14 of the garment assembly 10 are each disposed substantially over a corresponding shoulder of the individual. In order to facilitate forming a mating engagement, the first and the second connection structures 62 and 64 should be respectively disposed on the first and the second extended segments 12 and 14 in a manner that at least reduces the separation between them. By way of example, as is demonstrated at least in FIGS. 1A and 1B, the first and the second connection structures 62 and 64 may be respectively disposed on an inner portion of the first and the second extended segments 12 and 14.

Figure 3:
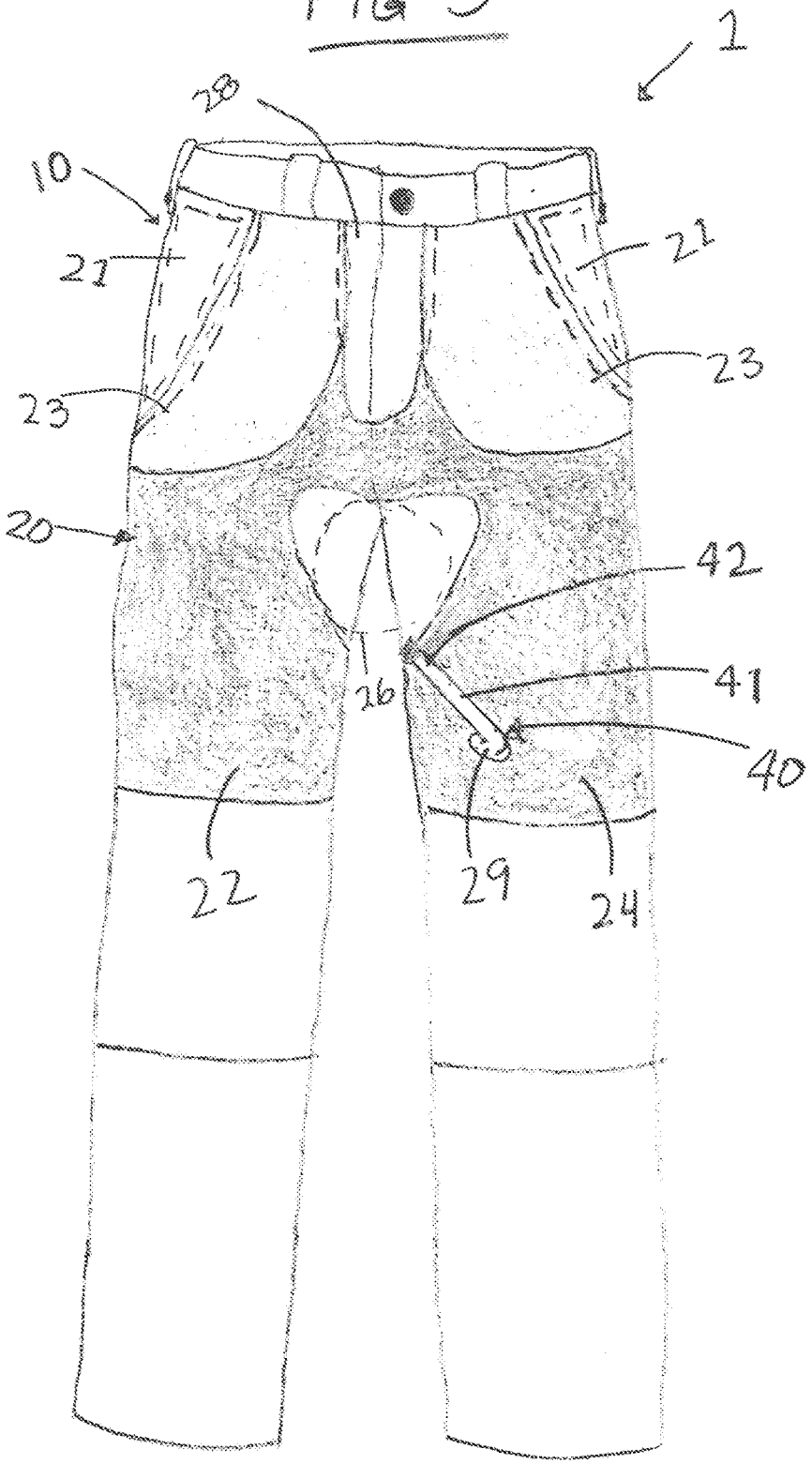
FIG. 3 is a front cutaway view of one embodiment of the garment assembly of the dress unit according to the present invention comprising an inflatable bladder.
Figure 9:
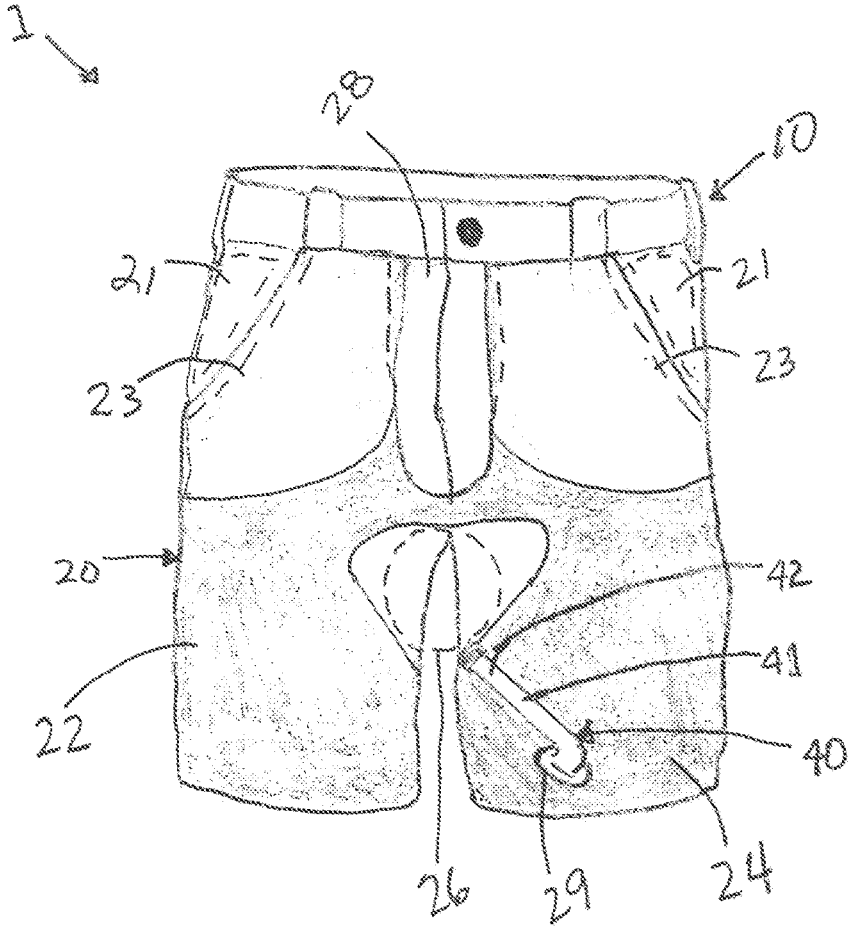
FIG. 9 is a front cutaway view of a different embodiment of the garment assembly of the dress unit according to the present invention.

As represented at least in FIGS. 3 and 9, the inflatable bladder 20 comprises a hollow portion, indicated as 26. As is perhaps best represented in FIG. 11, the hollow portion 26 is intended to correspond to the area of the garment assembly 10 where the first and second extended segments 12 and 14 joint or connect to the core segment 16. Furthermore, when the garment assembly is disposed in the flotation position, the hollow portion 26 is intended to at least partially surround the neck of the individual. As such, the hollow portion 26 helps to maintain the head of the individual above water. Also as shown at least in FIGS. 3 and 9, the inflatable bladder 20 may comprise a tapered configuration 23 to reduce an amount of material 21 required to fabricate the inflatable bladder 20. Furthermore, and as shown at least in FIGS. 3 and 9, the inflatable bladder 20 may be configured with a hollow segment 28 so that the garment assembly 10 may comprise an opening around the groin area. As an example, a waterproof zipper may be disposed around the groin area to provide a temporary opening when desired by the individual, but also to ensure that the zipper is water resistant when closed. It is within the scope of the present invention that connections including between different sections of the garment assembly 10, between the inflatable bladder 20 and the garment assembly 10, and between the pocket structure(s) 30 and the garment assembly 10, may be achieved by sewing, gluing, or other related methods.

Figure 6:
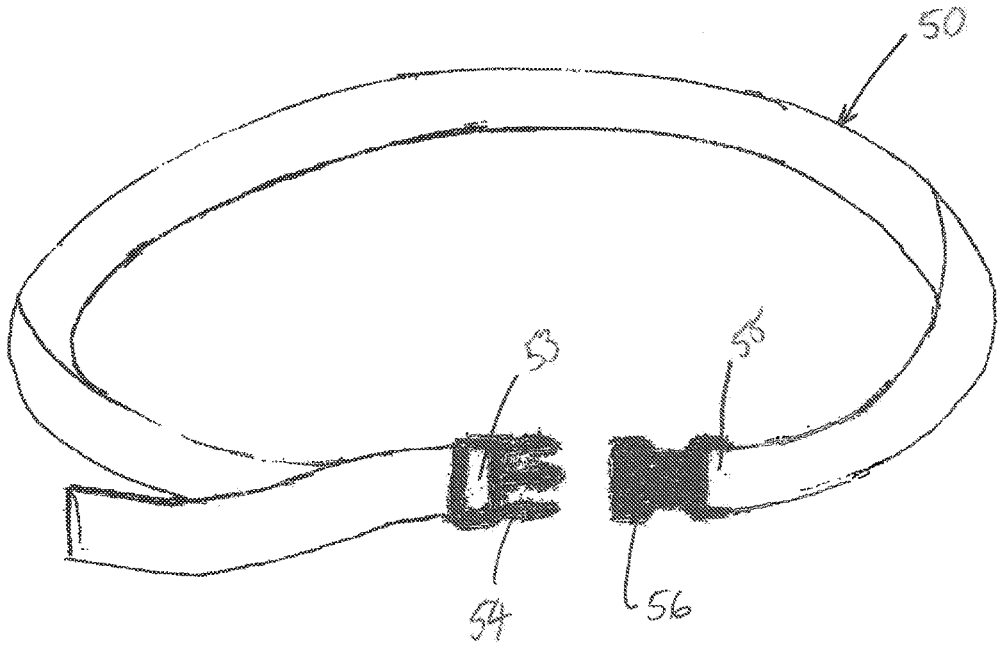
FIG. 6 is a perspective view of one embodiment of a strap of the dress unit according to the present invention.

As shown in FIG. 6, the garment assembly 10 may comprise a strap 50. When the garment assembly 10 is worn by the individual in the conventional position, the strap may be used to secure the garment assembly 10 to the individual around the waist area. When the garment assembly 10 is disposed in the flotation position, the strap 50 may be used in conjunction with the third 66 and fourth 68 connection structures to further secure the garment assembly 10 to the individual. As previously mentioned, and as shown at least in FIGS. 2, 7, and 8, the connection assembly 60 may comprise a third connection structure 66 and fourth connection structure 68 respectively disposed on the first extended segment 12 and the second extended segment 14. In contrast to the first and the second connection structures 62 and 64, the third and the fourth connection structures 66 and 68 should be respectively disposed on the first and second extended segments 12 and 14 in a manner that at least partially increases the separation between the connection structures 66 and 68. The third and the fourth connection structures 66 and 68 may comprise a configuration that enables an operative connection with the strap 50. The configuration of the connection structures 66 and 68 may be a hollow configuration or a similar configuration that permits the strap 50 to pass through each of the connection structures 66 and 68 effectively engaging them. The strap 50 may comprise a material such as, but not limited to polypropylene webbing.

As shown at least in FIGS. 1A, 1B, 2, 7, and 8, the garment assembly 10 may comprise a plurality of belt loops 52 that can secure the strap 50 to the garment assembly 10 around the waist of the individual. As shown in FIGS. 6 and 11, the strap 50 generally comprises two connectors 54 and 56 disposed on opposite ends 53 and 55 of the strap 50. The connectors 54 and 56 may form a mating engagement between them. For example, and as shown in FIG. 6, the connectors 54 and 56 may be in the form as side release buckles which can form a mating engagement. As shown in FIG. 11, the strap 50 may be connected to the garment assembly 10 in a way that further secures the garment assembly 10 to the individual. More specifically, and as is shown in FIG. 11, the strap 50 may be disposed around the back of the individual, and each connector 54 and 56 may be connected to a corresponding connection structure 66 and 68.

Moreover, one or both of the connectors 54 and 56 may be structured to adjust the length of the strap 50. By way of example only, the illustrative embodiment as shown in FIG. 6 comprises a connector 53 configured to permit adjustment of the length of the strap 50. Yet additional features of the inventive dress unit 1 include one or more pocket structure(s) 30 disposed on the garment assembly 10 and configured to retain a communication device 80. The pocket structure(s) 30 may be disposed on either the first or the second extended segments 12 and/or 14. As an example, the embodiments as represented in FIGS. 1A, 1B, 2, 7, and 8, comprise one pocket structure 30 disposed on the second 14 extended segment. The pocket structure(s) 30 may be connected to the garment assembly 10 by either sewing it, gluing it, or otherwise connecting it by another related method. The pocket structure(s) 30 may comprise a waterproof material that can prevent the passage of water to an inside of the pocket structure(s) 30. As such, the communication device 80 may remain at least partially operational even if the individual is submerged in the water. The communication device 80 may be a variety of devices structured to send a distress or emergency signal. It is also within the scope of the present invention that the communication device 80 be capable of placing an emergency call. Examples of the communication device 80 include, but are not limited to, cell phones, radios, tablets, and other related devices. The communication device 80 may include a touch screen or a button(s) that the individual may respectively touch or push to operate the communication device 80. Furthermore, the communication device 80 may comprise Global Positioning System (GPS) capabilities so that the distress or emergency signal may include information regarding the approximate location of the individual. Alternatively, the GPS capabilities would enable an outside source to determine the approximate location of the individual without the need to send an emergency or distress signal, or without the need of making an emergency call.

As is perhaps best represented in FIG. 1A, the pocket structure 30 may also comprise a clear or translucent material that permits the individual to observe the communication device 80 from an exterior of the pocket structure 30. For example, the pocket structure 30 may comprise a clear heat sealable waterproof fabric with a waterproof zipper. The pocket structure 30 may also comprise a cover, generally indicated as 34, which may be structured to correspond to an intended visual appearance of the garment assembly. That is, an exterior of the cover 34 may comprise the same or a similar material and/or color as the rest of the garment assembly 10. Furthermore, an interior of the cover 34 may comprise a material that may reflect light. Thus, light may be reflected to an inside of the pocket structure 30 when the cover 34 is opened. This reflective feature of the cover 34 enables the individual to better observe the inside of the pocket structure 30, which may be advantageous in situations when the individual needs to locate and/or directly access the communication device 80. Additionally, the pocket structure 30 may also comprise a flap 34' that may be used to further protect the inside of the pocket structure 30. The flap 34' may comprise a material that can be used to connect to the cover 34, such as, but not limited to the aforementioned Velcro®.

Both the inner portion of the cover 34, and at least a portion of the pocket structure 30, may comprise a material such as the material of the aforementioned fasteners 49 to facilitate opening the cover 34 to access the inside of the pocket structure 30. The material of the pocket structure 30 should be such that the individual may also at least partially control, or otherwise at least partially operate the communication device 80, from an outside of the pocket structure 30. The material of the pocket structure 30 should permit the individual to use the communication device 80 to send an emergency or distress signal, even when the garment assembly 10 is submerged underwater. More specifically, the individual may use one or more fingers to control the communication device 80 from an outside of the pocket structure 30. Some of the aforementioned examples of the communication device 80 may comprise a capacitive touch screen which a user may operate with a finger. Such capacitive touch screens are generally configured to operate based on a response to an electrical charge, such as the electrical charge that human skin naturally stores. Thus, the material of the pocket structure 30 should permit transmission of an electrical charge there through so that an individual may use a finger to control the screen of the communication device 80. Other touch screens may operate based on an applied pressure to the screen. Thus, the material of the pocket structure 30 should also permit transfer an applied pressure, such as a pressure applied by a human finger, to the screen of the communication device 80.

As represented at least in FIGS. 1A-2, and 7-8, the dress unit 1, and more specifically the garment assembly 10, may comprise a charging device 36 disposed within the pocket structure 30. The charging device 36 may be connected directly to the garment assembly 10, or may be connected to the pocket structure 30 and to the garment assembly 10. Alternatively, the charging device 36 may be directly connected to the garment assembly 10. Preferably, the charging device 36 should be disposed on the inside of the pocket structure 30 to prevent moisture damage. The charging device 36 is configured to replenish the charge of the communication device 80, and may be battery powered or solar powered. Further, the charging device 36 may be a wireless charging device. Solar radiation may pass through the clear or transparent material of the pocket structure 30, and may reach the solar powered charging device enabling its operation. The communication device 80 may also be securely disposed or otherwise stored on the charging device 36 itself. Such a feature is advantageous to prevent shifting or displacement of the communication device 80 within the pocket structure 30. Additionally, if the communication device 80 is securely disposed on the charging device 36, the charging device 36 may be configured to directly connect to the charging port of the communication device 80 in lieu of replenishing the charge of the communication device 80 through wireless capabilities. By way of example only, the charging device 36 may comprise a solar powered panel with a built in USB that may attach to the charging port of the communication device 80 and retain the communication device 80 in a fixed position to prevent shifting within the pocket structure 30.

The present invention is also directed towards a method 100 for providing flotation to the individual. As represented in FIG. 14, the method 100 comprises providing a dress unit comprising a garment assembly, an inflation device disposed in fluid communication to the inside of the inflatable bladder, and a plurality of connection structures disposed on the garment assembly, the garment assembly wearable at all times when in a conventional position, and disposable into a flotation position when desired 110. The method 100 further comprises removing the dress unit from the individual, when worn in the conventional position 120, and disposing the inflatable bladder into an expanded orientation by blowing air through the inflatable device 130, and disposing the garment assembly into a flotation position, the flotation position comprising at least partially disposing the garment assembly in secured relation to the individual by disposing the plurality of connection structures in retaining engagement with one another.

As represented in FIG. 15, in an alternative embodiment of the method 100 according to the present invention comprises providing a dress unit comprising a garment assembly, an inflatable bladder connected to the garment assembly, an inflation device disposed in fluid communication to the inside of the inflatable bladder, and a plurality of connection structures disposed on the garment assembly, the plurality of connection structures comprising a first and a second connection structure disposed on the garment assembly, the garment assembly wearable at all times when in a conventional position, and disposable into a flotation position when desired 112. The method 100 further comprises removing the dress unit from the individual, when worn in the conventional position 120, and disposing the inflatable bladder into an expanded orientation by blowing air through the inflatable device 130, and disposing the garment assembly into a flotation position, the flotation position comprising at least partially disposing the garment assembly in secured relation to the individual by disposing the first and the second connection structures in retaining engagement with one another 142.

As represented in FIG. 16, a further alternative embodiment of the method 100 according to the present invention comprises providing a dress unit comprising a garment assembly, an inflatable bladder connected to the garment assembly, an inflation device disposed in fluid communication to the inside of the inflatable bladder, a strap connected to the garment assembly, and a plurality of connection structures disposed on the garment assembly, the plurality of connection structures comprising a first, a second, a third, and a fourth connection structure disposed on the garment assembly, the garment assembly wearable at all times when in a conventional position, and disposable into a flotation position when desired 114. The method 100 further comprises removing the dress unit from the individual, when worn in the conventional position 120, and disposing the inflatable bladder into an expanded orientation by blowing air through the inflatable device 130, and disposing the garment assembly into a flotation position, the flotation position comprising at least partially disposing the garment assembly in secured relation to the individual by disposing the first and the second connection structures in mating engagement with one another, and by connecting the strap to the third and fourth connection structures 144.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A wearable dress unit structured to provide flotation to an individual, said dress unit comprising:

a garment assembly structured for disposition on the individual in a conventional position and in a flotation position, an inflatable bladder connected to at least a portion of said garment assembly, a connection assembly comprising a plurality of connection structures each disposed on an exterior of said garment assembly, an inflation assembly disposed on said garment in fluid communication with an inside of said inflatable bladder and operable to dispose said inflatable bladder into an expanded orientation, a pocket structure connected to said garment assembly and configured to retain a communication device, a charging assembly disposed within said pocket structure and configured to replenish an electrical charge of the communication device, and said flotation position comprising said garment assembly secured in flotation supporting relation to the individual concurrent to said bladder disposed in said expanded orientation.

2. The dress unit as recited in claim 1 wherein said pocket structure comprises a waterproof material.

3. The dress unit as recited in claim 1 wherein said charging assembly comprises a solar powered charging device.

4. The dress unit as recited in claim 3 wherein said pocket structure comprises a transparent material, such that an inside of said pocket structure is exposed to solar radiation and is visually observable from an exterior of said pocket structure.

5. The dress unit as recited in claim 3 wherein said pocket structure comprises a material that is structured to permit transmission of an electrical charge to at least partially operate the communication device.

6. The dress unit as recited in claim 1 wherein said inflation assembly comprises a release valve operable to dispose said inflatable bladder into a collapsed orientation.

7. The dress unit as recited in claim 1 wherein said inflatable bladder is connected to said garment assembly on an inside of said garment assembly.

8. The dress unit as recited in claim 1 wherein said garment assembly comprises a front section and a rear section connected to one another, said inflatable bladder connected to at least a portion of said front section.

9. The dress unit as recited in claim 1 wherein said garment assembly comprises a first and a second extended segment each connected to a core segment.

10. The dress unit as recited in claim 9 wherein said plurality of connection structures comprise a first and a second connection structure respectively disposed on said first and said second extended segments.

11. The dress unit as recited in claim 10 wherein said flotation position further comprises said first and said second connection structures disposed in retaining engagement with one another and said garment assembly at least partially disposed in secured relation to the individual.

12. The dress unit as recited in claim 11 wherein said plurality of connection structures further comprise a third and a fourth connection structure respectively disposed on said first and said second extended segments.

13. The dress unit as recited in claim 12 wherein said flotation position further comprises said third and said fourth connection structures disposed in retaining engagement with one another and said garment assembly disposed in secured relation to the individual.

14. The dress unit as recited in claim 9 further comprising a strap connected to the garment assembly and structured to at least partially dispose the garment assembly in secured relation to the individual.

15. The dress unit as recited in claim 14 wherein said plurality of connection structures comprise a third and a fourth connection structure respectively disposed on said first and said second extended segments, said flotation position further comprising said strap connected to said third and said fourth connection structures in secured relation to the individual.

* * * * *